US008480219B2

(12) United States Patent
Aoi et al.

(10) Patent No.: US 8,480,219 B2
(45) Date of Patent: Jul. 9, 2013

(54) INK CARTRIDGE AND INK-JET RECORDING APPARATUS

(75) Inventors: Noriatsu Aoi, Ichinomiya (JP); Kazuma Goto, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 98 days.

(21) Appl. No.: 13/075,295

(22) Filed: Mar. 30, 2011

(65) Prior Publication Data

US 2011/0267408 A1 Nov. 3, 2011

(30) Foreign Application Priority Data

Apr. 30, 2010 (JP) ..... 2010-105874

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 4,890,126 | A * | 12/1989 | Hotomi | 347/45 |
| 5,609,671 | A | 3/1997 | Nagasawa | |
| 5,837,045 | A | 11/1998 | Johnson et al. | |
| 6,270,212 | B1 * | 8/2001 | Kusumi et al. | 347/93 |
| 6,540,314 | B1 | 4/2003 | Sanada et al. | |
| 6,637,859 | B2 * | 10/2003 | Williamson et al. | 347/36 |
| 6,863,391 | B2 | 3/2005 | Tomioka et al. | |
| 7,040,747 | B2 | 5/2006 | Kubota et al. | |
| 7,621,630 | B2 * | 11/2009 | Ito et al. | 347/100 |
| 2001/0035897 | A1 * | 11/2001 | Hayashi et al. | 347/65 |
| 2005/0012798 | A1 | 1/2005 | Adachi et al. | |
| 2006/0098068 | A1 | 5/2006 | Hakamada et al. | |
| 2006/0197814 | A1 * | 9/2006 | Doi | 347/100 |
| 2007/0100023 | A1 | 5/2007 | Burns et al. | |
| 2007/0100024 | A1 | 5/2007 | Gu et al. | |
| 2007/0247504 | A1 * | 10/2007 | Koganehira et al. | 347/100 |
| 2008/0239036 | A1 * | 10/2008 | Hattori | 347/86 |
| 2008/0246820 | A1 | 10/2008 | Silverbrook | |
| 2011/0227996 | A1 | 9/2011 | Ikoshi | |
| 2012/0092413 | A1 | 4/2012 | Kawamura | |

FOREIGN PATENT DOCUMENTS

| | | |
|---|---|---|
| JP | 08-003498 | 1/1996 |
| JP | 2000-198222 | 7/2000 |
| JP | 2000-513396 | 10/2000 |
| JP | 2001-162817 | 6/2001 |
| JP | 2009-515007 | 4/2009 |

* cited by examiner

*Primary Examiner* — Matthew Luu
*Assistant Examiner* — Michael Konczal
(74) *Attorney, Agent, or Firm* — Banner & Witcoff, Ltd.

(57) ABSTRACT

Provided is an ink cartridge for containing a water-based ink for ink-jet recording including a pigment, water, and a non-ionic surfactant, the ink cartridge including a remaining ink detecting portion detecting an amount of remaining ink on the basis of whether or not light is transmitted therethrough. The remaining ink detecting portion is formed of a hydrophobic resin containing a water-repellent material in the proportion of 0.14 wt % to 10 wt %.

11 Claims, 8 Drawing Sheets

A

B

C

INK CARTRIDGE AND INK-JET RECORDING APPARATUS

CROSS-REFERENCE TO RELATED APPLICATION

This application claims priority from Japanese Patent Application No. 2010-105874 filed on Apr. 30, 2010. The entire subject matter of the Japanese Patent Applications is incorporated herein by reference.

BACKGROUND

In ink-jet recording, an ink cartridge containing an ink is used. There is a case in which the ink cartridge is provided with a remaining ink detecting portion detecting the amount of remaining ink. The remaining ink detecting portion detects the amount of remaining ink on the basis of whether or not light is transmitted therethrough. On the other hand, there is a case in which a water-based ink of higher penetration (wettability) relative to a recording medium is used for the purpose of improving the quality of a recorded image in ink-jet recording. However, when the water-based ink of higher penetration is contained in an ink cartridge, even in the case where light should be transmitted through the remaining ink detecting portion with the decrease of water-based ink, there is the possibility that the water-based ink remains in the remaining ink detecting portion and inhibits the light transmission. This may cause a detection error. In order to solve the problem, it has been proposed to form a water-repellent membrane (ink-repellent membrane) on the remaining ink detecting portion of the ink cartridge by applying polyorganosiloxane.

However, in the aforementioned method, there is the possibility that the water-repellent membrane comes off over time, for example, and the prevention of the error in the detection of remaining ink is insufficient. Further, in the method, there is also the problem that the water-based ink may be contaminated with the water-repellent membrane that came off.

SUMMARY

An ink cartridge for containing a water-based ink for ink-jet recording comprising a pigment, water, and a nonionic surfactant comprises a remaining ink detecting portion detecting an amount of remaining ink on the basis of whether or not light is transmitted therethrough. The remaining ink detecting portion is formed of a hydrophobic resin containing a water-repellent material in the proportion of 0.14 wt % to 10 wt %.

An ink-jet recording apparatus comprises an ink cartridge, an ink ejecting unit, and a remaining ink detecting unit. The ink ejecting unit ejects an ink contained in the ink cartridge. The ink cartridge is the aforementioned ink cartridge. The remaining ink detecting unit comprises a transmissive optical sensor provided with a light emitting portion and a light receiving portion. The remaining ink detecting portion of the ink cartridge is placed between the light emitting portion and the light receiving portion.

DETAILED DESCRIPTION

The "hydrophobic resin containing a water-repellent material" is a hydrophobic resin in which a water-repellent material is mixed by a polymer blend or a polymer alloy, for example.

The range "0.14 wt % to 10 wt %" is the proportion of the water-repellent material relative to the total amount of the water-repellent material and the hydrophobic resin.

The ink cartridge described below is illustrative only and the present invention is not limited to the embodiment below.

Figure 1:
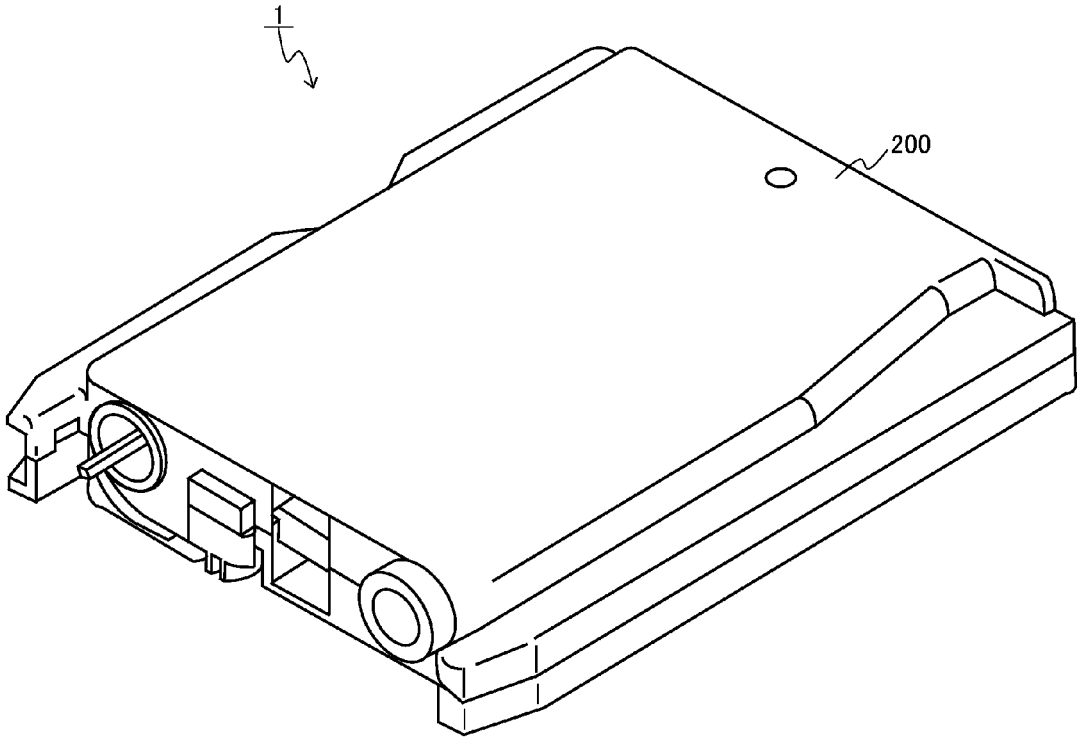
FIG. 1 is an external perspective view showing an example of the configuration of the ink cartridge.

As shown in the external perspective view of FIG. 1, an ink cartridge 1 is substantially hexahedral. In other words, the ink cartridge 1 comprises six faces in total, namely, a pair of substantially rectangular faces having largest area and four side faces positioned in four directions that connect the substantially rectangular faces. Hereinafter, the direction along the long side of the substantially rectangular faces is referred to as the longitudinal direction, the direction along the short side of the substantially rectangular faces is referred to as the short-side direction, and the direction orthogonal to the longitudinal direction and the short-side direction is referred to as the width direction. Further, one of the substantially rectangular faces is referred to as the front face and the other of the substantially rectangular faces is referred to as the back face.

Figure 2A:
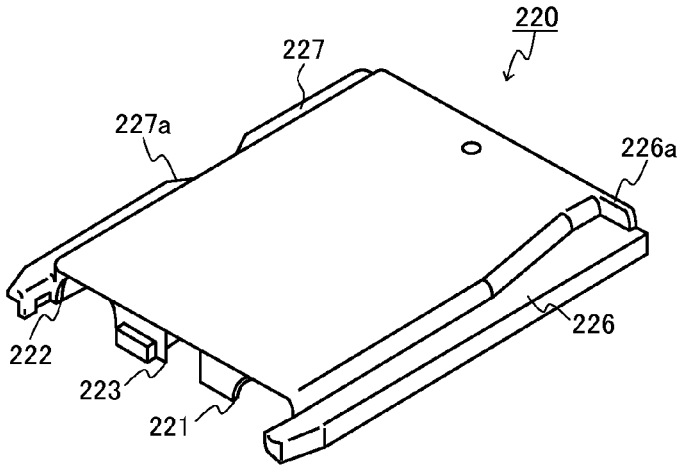
FIG. 2A is an exploded perspective view showing the second case member of the ink cartridge shown in FIG. 1.
Figure 2B:
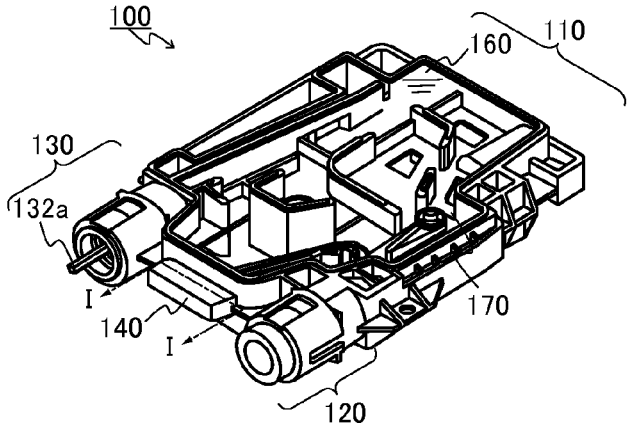
FIG. 2B is an exploded perspective view showing the ink reservoir of the ink cartridge shown in FIG. 1.
Figure 2C:
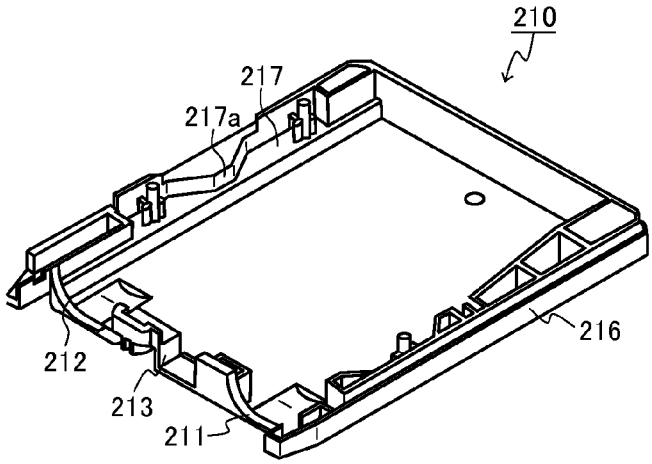
FIG. 2C is an exploded perspective view showing the first case member of the ink cartridge shown in FIG. 1.

As shown in the external perspective view of FIG. 1 and the exploded perspective views of FIGS. 2A to 2C, the ink cartridge 1 is provided with a case 200 (a first case member 210 and a second case member 220) with which the whole of an ink reservoir 100 storing ink is substantially covered. In the present embodiment, the ink reservoir 100 and the case 200 are made of resin material. Examples of the resin material include polypropylene (PP), polyethylene (PE), nylon, and the like. The material for forming a remaining ink detecting portion 140 will be described below.

As shown in FIG. 2B, the ink reservoir 100 is provided with an ink tank 110, an ink supply portion 120, and an air intake portion 130. The ink tank 110 stores ink, the ink supply portion 120 supplies the ink stored in the ink tank 110 to the outside (an ink-jet recording apparatus 1000 that will be described below (see FIG. 7)), and the air intake portion 130 introduces air into the ink tank 110. The ink tank 110 comprises a main body portion 170 and a remaining ink detecting portion 140. The remaining ink detecting portion 140 is protruded in the longitudinal direction from the main body portion 170 between the ink supply portion 120 and the air intake portion 130, and has a space therein that is in communication with the main body portion 170. In other words, the ink supply portion 120, the air intake portion 130 and the remaining ink detecting portion 140 are provided on the same wall side of the ink reservoir 100.

Figure 3:
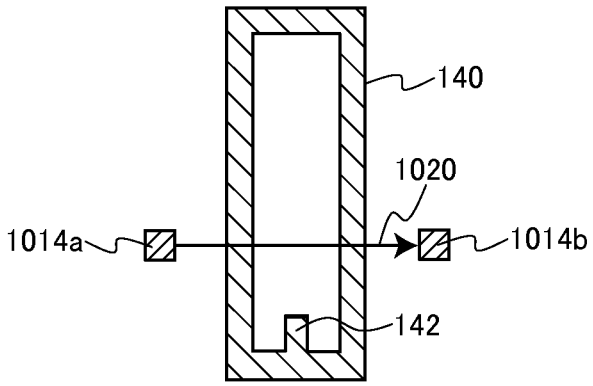
FIG. 3 is a cross sectional view of the ink reservoir taken along the line I-I in FIG. 2B.

Next, referring to FIG. 3, the remaining ink detecting portion 140 will be described. For convenience in explanation, FIG. 3 shows a light emitting portion 1014*a* and a light receiving portion 1014*b* of a transmissive optical sensor 1014 (see FIG. 7) provided in the ink-jet recording apparatus 1000. The remaining ink detecting portion 140 has a light transmissivity and is placed between the light emitting portion 1014*a* and the light receiving portion 1014*b* of the transmissive optical sensor 1014 provided in the ink-jet recording apparatus 1000 when the ink cartridge 1 is installed in the ink-jet recording apparatus 1000. Light (for example, infrared light) 1020 emitted from the light emitting portion 1014*a* is transmissive through the remaining ink detecting portion 140 toward the light receiving portion 1014*b*. A stopper 142 will be described below.

The remaining ink detecting portion 140 is formed of a hydrophobic resin containing a water-repellent material in the proportion of 0.14 wt % to 10 wt %. The material for forming the remaining ink detecting portion 140 may also comprise components other than the water-repellent material and hydrophobic resin. When the proportion of the water-repellent material is 0.14 wt % or more, the loss of water repellency due to coming off of a water-repellent membrane as a conventional water-repellent membrane is prevented and the sufficient water repellency is kept over a long period of time. Therefore, even when the water-based ink of higher penetration using a nonionic surfactant is contained, the error in the detection of remaining ink is sufficiently prevented. Further, when the proportion of the water-repellent material is 10 wt % or less, the elution of the water-repellent material from the remaining ink detecting portion to the water-based ink is prevented and the ejection failure due to the elution does not occur. The proportion of the water-repellent material may be in the range from 0.35 wt % to 6.4 wt %.

As the hydrophobic resin, for example, a resin having surface free energy of 45 J/m$^2$ or less may be used. Examples thereof include polyolefin (for example, polypropylene (PP), surface free energy: 29 J/m$^2$; and polyethylene (PE), surface free energy: 31 J/m$^2$), polyethylene terephthalate (PET, surface free energy: 43 J/m$^2$), polystyrene (PS, surface free energy: 33 J/m$^2$), polymethylmethacrylate (PMM, surface free energy: 39 J/m$^2$), polyvinyl chloride (surface free energy: 39 J/m$^2$), and the like. Among them, in view of a solvent resistance (ink resistance), a light transmissivity (transparency), and a workability, polyolefin is preferred, polypropylene (PP) and polyethylene (PE) are more preferred, and polypropylene (PP) is particularly preferred. For example, commercially available hydrophobic resins may be used. Examples thereof include "PRIME POLYPRO® J227T" (PP) and "PRIME POLYPRO® J-3000GP" (PP) manufactured by Prime Polymer Co., Ltd; and the like. One of the hydrophobic resins may be used alone or two or more of them may be used in combination.

As the water-repellent material, a material having lower surface free energy than the hydrophobic resin that is used together may be used. Examples thereof include silicon-containing compounds, fluorine-containing compounds, and the like. For example, in the case where polyolefin is used as the hydrophobic resin, polyorganosiloxane may be used as the water-repellent material because polyorganosiloxane has superior mixability with polyolefin. For example, commercially available water-repellent materials may be used. Examples thereof include "POLYFINE® MF18R" (containing 7 wt % of polyorganosiloxane) manufactured by Prime Polymer Co., Ltd., "DOW CORNING TORAY BY27-001" (containing 50 wt % of polyorganosiloxane) manufactured by Dow Corning Toray Co., Ltd, and the like. One of the water-repellent materials may be used alone or two or more of them may be used in combination. In Examples that will be described below, the commercially available water-repellent materials containing polyorganosiloxane are mixed with the hydrophobic resin. However, a water-repellent material containing no other components may be mixed with the hydrophobic resin.

Figure 4:
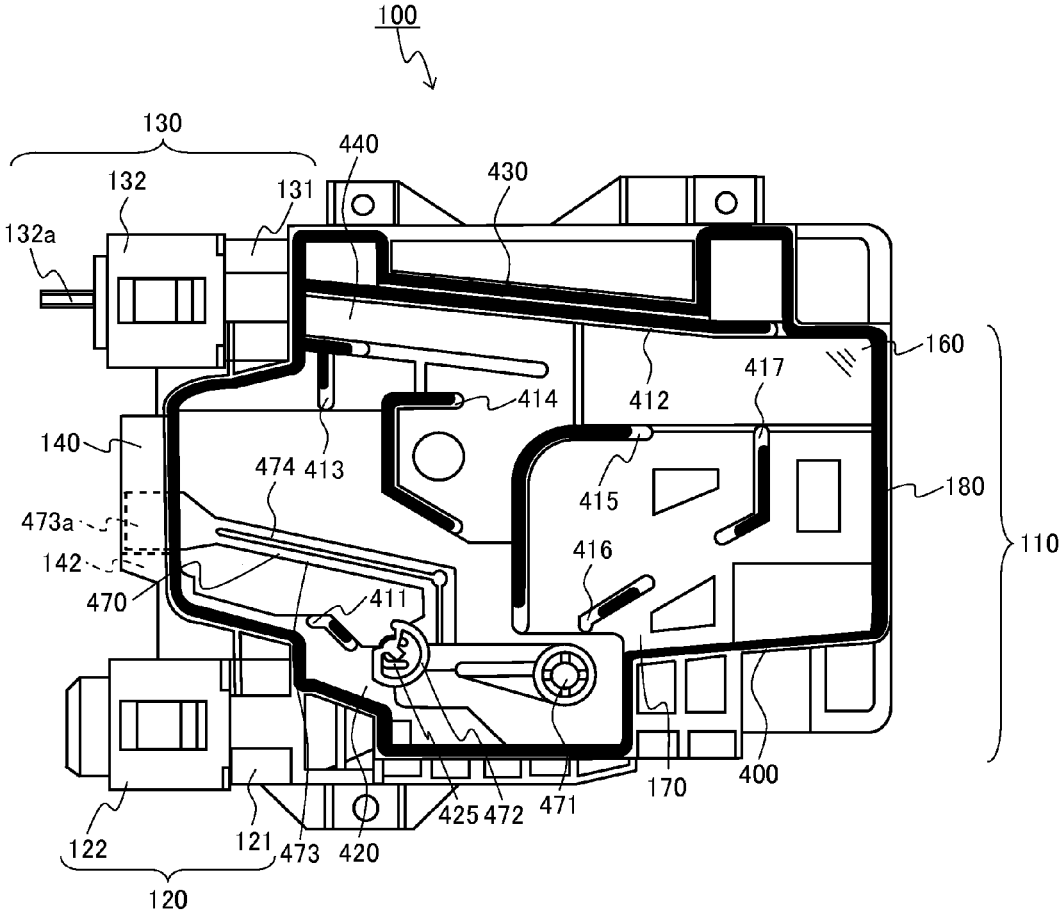
FIG. 4 is a plan view of the ink reservoir shown in FIG. 2B.

Next, referring to FIG. 4, the ink reservoir 100 will be described in detail. As shown in FIG. 4, the ink reservoir 100 is mainly provided with the ink tank 110, the ink supply portion 120, and the air intake portion 130.

Figure 7:
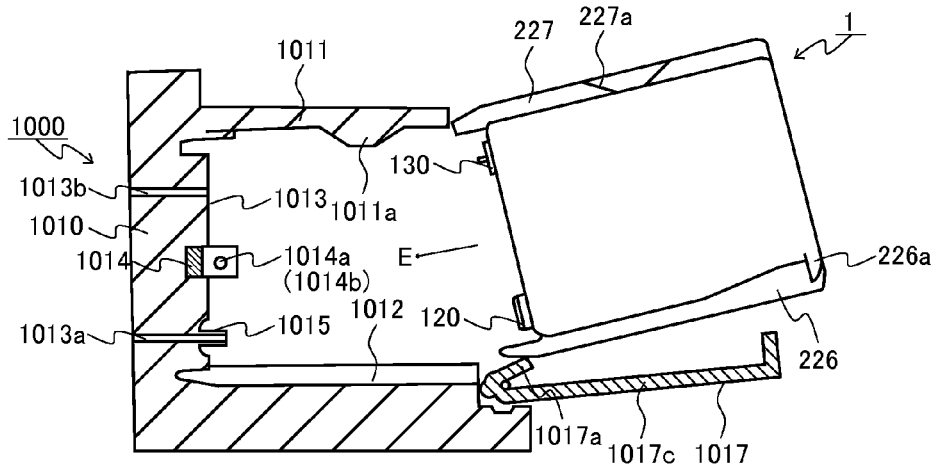
FIG. 7 is an explanatory view for explaining the method of installing the ink cartridge shown in FIG. 1 to the ink-jet recording apparatus.
Figure 7:
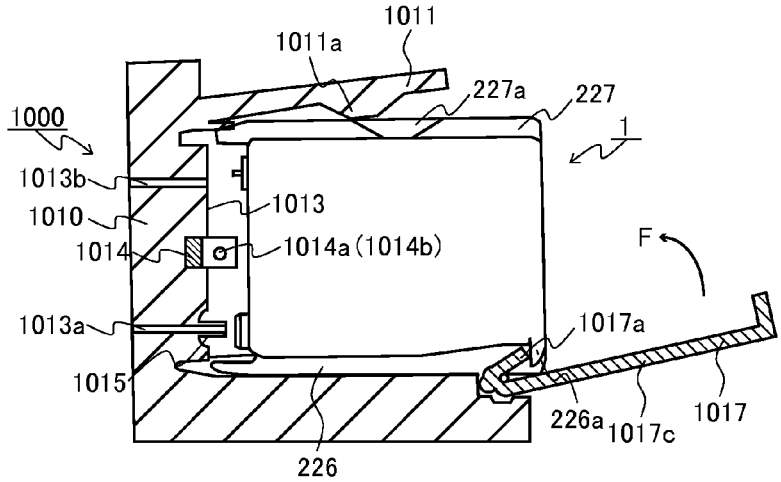
Figure 7:
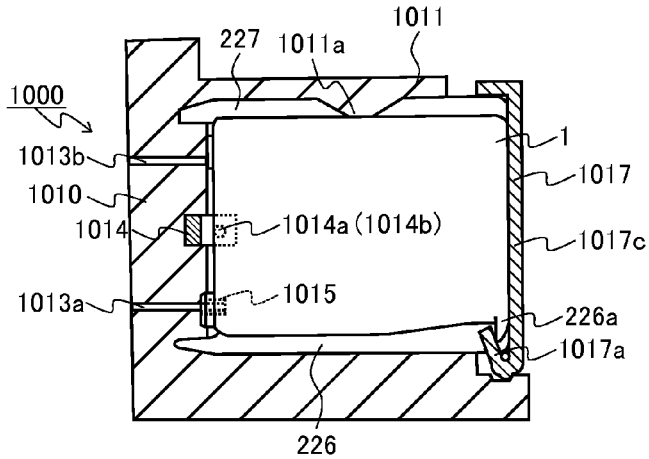

The state of the ink reservoir 100 shown in FIG. 4 is the orientation in which the ink cartridge 1 is installed in the ink-jet recording apparatus 1000 (see FIG. 7). In other words, the ink cartridge 1 is installed in the ink-jet recording apparatus 1000 in the orientation with the faces having largest area being vertical and the long side of the faces having largest area being horizontal. At this time, the ink supply portion 120 and the air intake portion 130 are positioned on sides of the ink cartridge 1. Specifically, the ink supply portion 120 is positioned on the bottom side and the air intake portion 130 is positioned at the ceiling side. In the following description, the up-and-down direction will be defined taking the ceiling side of the ink cartridge 1 in the orientation of installation in the ink-jet recording apparatus 1000 will be defined as "up" and the bottom side as "down". In other words, the direction of displacement of the ink level accompanying the decrease of ink stored in the ink reservoir 100 is the up-and-down direction.

As shown in FIG. 4, the main body portion 170 comprises a frame portion 180 and a film 160. The frame portion 180 has edge portions at the front face side and the back face side of the main body portion 170, respectively. The film 160 is welded to the edge portions at the front face side and the back face side of the frame portion 180. In the present embodiment, by sealing the both sides, namely, the front face side and back face side of the frame portion 180, with the film 160, the space in which an ink is stored is formed in the main body portion 170. Therefore, the thickness of the ink reservoir 100 is reduced as compared to the case where the both sides are sealed with side walls.

The frame portion 180 has faces that are parallel to the width direction of the ink tank 110. The frame portion 180 is provided with an outer peripheral welded portion 400, inner welded portions 411 to 417, and connecting portions 420, 430, and 440. The outer peripheral welded portion 400 is a vertical wall that demarcates the inner space of the main body portion 170. The inner welded portions 411 to 417 have faces that are parallel to the width direction of the ink tank 110 and are placed at the inside of the outer peripheral welded portion 400. The connecting portions 420, 430, and 440 have faces that are orthogonal to the width direction of the ink tank 110 and connect the outer peripheral welded portion 400 and the inner welded portions 411 to 417. The connecting portion 420 connects the outer peripheral welded portion 400 and the inner welded portion 411 at the lower left of FIG. 4. The connecting portion 430 connects the outer peripheral welded portion 400 and the inner welded portion 412 at the upper side of FIG. 4. The connecting portion 440 connects the outer peripheral welded portion 400 and the inner welded portions 413 to 417 from the upper left of FIG. 4 to the lower right of FIG. 4. In FIG. 4, blackened areas of the outer peripheral welded portion 400 and the inner welded portions 411 to 417 are positioned on the same virtual plane and the film 160 is welded on the blackened areas. Further, the connecting portion 420 is provided with an arm holding portion 425 that supports an attachment portion 472 of a sensor arm 470 that will be described below from both sides.

As shown in FIG. 4, at least some of the vertical walls of the inner welded portions 411 to 417 are sloped downward relative to the longitudinal direction of the frame portion 180 or extended in the direction substantially orthogonal to the longitudinal direction of the frame portion 180, i.e., toward the bottom of the ink cartridge 1, and the lower end portions of the inner welded portions 411 to 417 are not connected to the outer peripheral welded portion 400. As a result, even when the inner welded portions 411 to 417 are provided at the inside of the outer peripheral welded portion 400 for the purpose of suppressing the slack of the film 160 when the film 160 is to be welded to the frame portion 180, the hindrance of the flow of ink due to the inner welded portions 411 to 417 is reduced. Further, since the inner welded portions 411 to 417 are scattered about the inside of the outer peripheral welded portion 400, the slack of the film 160 is reduced and the hindrance of the flow of ink is effectively reduced.

As shown in FIG. 4, the ink supply portion 120 comprises a cylindrical ink supply passage 121 and an ink supply mechanism 122. The ink supply passage 121 is in communication with the ink tank 110 and is extended in the longitudinal direction. A part of the ink supply mechanism 122 is inserted into the ink supply passage 121. The ink supply mechanism 122 closes a passage of ink in the condition where the ink cartridge 1 is not installed in the ink-jet recording apparatus 1000 and opens the passage of ink in the condition where the ink cartridge 1 is installed in the ink-jet recording apparatus 1000 and an ink extraction tube 1015 (see FIG. 7) of the ink-jet recording apparatus 1000 is introduced into the ink cartridge 1. Accordingly, the ink supply portion 120 supplies the ink stored in the ink tank 110 to the ink-jet recording apparatus 1000 in the condition where the ink cartridge 1 is installed in the ink-jet recording apparatus 1000.

The air intake portion 130 comprises a cylindrical air communication passage 131 and an air intake mechanism 132 having a rodlike valve opening portion 132*a*. The air communication passage 131 is in communication with the ink tank 110 and is extended in the longitudinal direction. A part of the valve opening portion 132*a* is inserted into the air communication passage 131 and the valve opening portion 132*a* is protruded toward the outside of the air communication passage 131. The air intake mechanism 132 closes a passage of air in the condition where the ink cartridge 1 is not installed in the ink-jet recording apparatus 1000 and opens the passage of air in the condition where the ink cartridge 1 is installed in the ink-jet recording apparatus 1000 and the valve opening portion 132*a* is brought into contact with an installation surface 1013 (see FIG. 7) of the ink-jet recording apparatus 1000 and is pressed toward the inside of the air communication passage 131. Accordingly, the air intake portion 130 allows the inside of the ink tank 110 to be in communication with air in the condition where the ink cartridge 1 is installed in the ink-jet recording apparatus 1000.

Figure 5A:
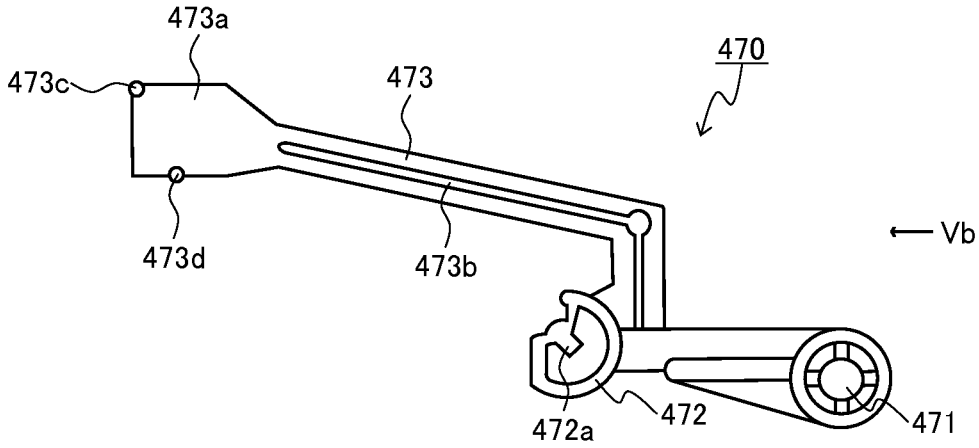
FIG. 5A is a front view of the sensor arm of the ink reservoir shown in FIG. 4.
Figure 5B:
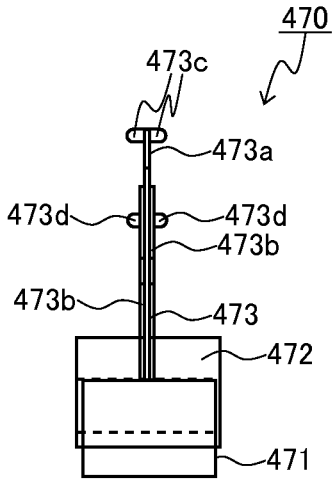
FIG. 5B is a view of the sensor arm viewed from the direction of the arrow Vb in FIG. 5A.

In the ink tank 110, provided is a sensor arm 470 that is capable of pivoting about a pivot provided in the vicinity of the lower left of FIG. 4, i.e., the vicinity of the ink supply portion 120 accompanying the decrease of the ink stored in the ink tank 110. Referring to FIGS. 5A and 5B, the sensor arm 470 will be described. The sensor arm 470 is the member for detecting the amount of ink that remains in the ink tank 110. Further, the sensor arm 470 is composed of a resin material (for example, a styrene resin) with a specific gravity lower than the specific gravity of the ink.

The sensor arm 470 is a pivoting member, which is pivotally supported in the ink tank 110 and pivots in response to the amount of remaining ink. The sensor arm 470 comprises an attachment portion 472, a float portion 471, and an arm portion 473. The attachment portion 472 is provided with an attachment shaft 472*a* that is attached to the substantially C-shaped arm holding portion 425 (see FIG. 4) provided in the main body portion 170. The float portion 471 is positioned on the right side of the attachment portion 472 in FIG. 5A. The arm portion 473 is extended from the attachment portion 472 in the direction substantially vertical relative to the float portion 471 (upward in FIG. 5A) and extended further upward in sloping fashion. The volume of the float portion 471 is made sufficiently larger than that of the arm portion 473. Further, the end portion of the arm portion 473 (the left end in FIG. 5A) constitutes a detection target portion 473*a* to be detected by the transmissive optical sensor 1014 (see FIG. 7) provided in the ink-jet recording apparatus 1000. The detection target portion 473*a* has a plate shape with faces that are parallel to the plane of paper of FIG. 5A. In the condition where the sensor arm 470 is attached to the inside of the ink tank 110, as shown in FIG. 4, the detection target portion 473*a* of the sensor arm 470 is placed in the space of the remaining ink detecting portion 140.

The sensor arm 470 comprises the detection target portion 473*a* at one end (the left end in FIG. 5A) and the float portion 471 at the other end (the right end in FIG. 5A) and is able to pivot about the attachment portion 472. As shown in FIG. 5A, the length from the attachment portion 472, which is the center of pivoting, to the detection target portion 473*a* is longer than the length from the attachment portion 472 to the end portion of the float portion 471. The rotation of the sensor arm 470 in the clockwise direction in FIG. 4 is restricted by the contact of the float portion 471 with the bottom wall of the ink tank 110. Further, the rotation of the sensor arm 470 in the counterclockwise direction in FIG. 4 is restricted by the contact of the detection target portion 473*a* with the stopper 142. In this manner, the range of pivoting of the sensor arm 470 is restricted by the bottom wall of the ink tank 110 and the stopper 142 in such a manner that it pivots within a predetermined pivoting path.

In the arm portion 473, a rib 473*b* that is protruded in the width direction (the left-right direction in FIG. 5B) is formed to maintain strength. Substantially hemispherical arm protrusion portions 473*c* and 473*d* are provided at two locations at the top and bottom of the detection target portion 473*a* (the upper end portion and the lower end portion in FIG. 5A). Since the arm protrusion portions 473*c* and 473*d* are each formed into a hemispherical shape, the parts that contact with the inner wall of the remaining ink detecting portion 140 are only the tips of the arm protrusion portions 473*c* and 473*d*, thus making it possible to reduce the influence of the surface tension of ink.

As described above, the sensor arm 470 is composed of a resin material with a specific gravity lower than the specific gravity of the ink. Further, the volume of the float portion 471 is made sufficiently larger than that of the arm portion 473. In the sensor arm 470, it is set that when the float portion 471 is positioned inside the ink liquid, the moment in the counterclockwise direction in FIG. 5A acting on the sensor arm 470 by gravity and buoyancy will be greater than the moment in the clockwise direction, and when a part of the float portion 471 is exposed from the ink liquid, the buoyancy acting on the float portion 471 decreases and the counterclockwise moment and clockwise moment become equal. Therefore, after a part of the float portion 471 has been exposed from the ink liquid and the ink level drops further as the ink decreases, the float portion 471 moves downward following the ink level. When the float portion 471 moves downward, the arm portion 473 moves upward about the attachment shaft 472*a* of the attachment portion 472 as the pivot.

Next, referring to FIGS. 6A to 6C, the configuration of the remaining ink detecting portion 140 will be described.

Figure 6A:
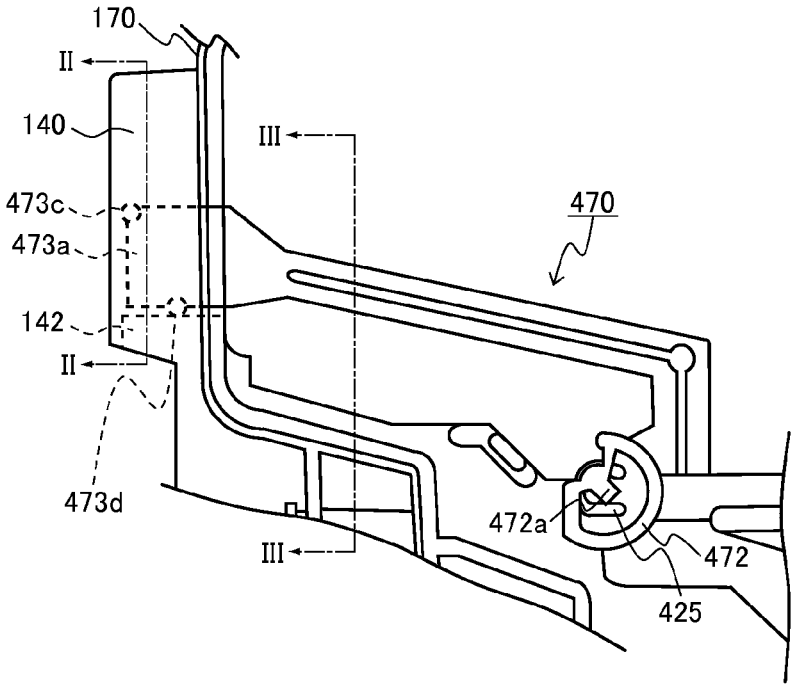
FIG. 6A is a schematic front view showing the vicinity of the remaining ink detecting portion of the ink reservoir shown in FIG. 4.
Figure 6B:
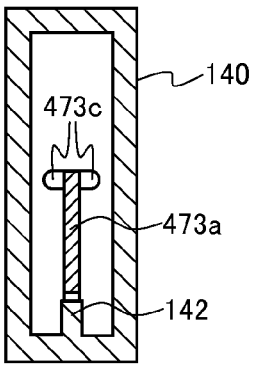
FIG. 6B is a cross sectional view of the remaining ink detecting portion taken along the line II-II in FIG. 6A.

As shown in FIG. 6A, the remaining ink detecting portion 140 is protruded outward from the main body portion 170 (to the left in FIG. 6A). As shown in FIGS. 6B and 6C, in the remaining ink detecting portion 140, formed is a space that is in communication with the inside of the main body portion 170 and extended in the up-and-down direction. Further, the detection target portion 473*a* provided on one end of the sensor arm 470 is placed in the space of the remaining ink detecting portion 140. The detection target portion 473*a* is displaceable in the up-and-down direction in the remaining ink detecting portion 140. Furthermore, the stopper 142, which supports the sensor arm 470 from below and restricts the displacement of the sensor arm 470, is provided in the remaining ink detecting portion 140.

As described above, the remaining ink detecting portion 140 has a light transmissivity, and placed between the light emitting portion 1014*a* and the light receiving portion 1014*b* (see FIG. 7) of the transmissive optical sensor 1014 provided in the ink-jet recording apparatus 1000 when the ink cartridge 1 is installed in the ink-jet recording apparatus 1000. Further, the sensor arm 470 has a light blocking ability. Consequently, as described above, when the ink level drops as the ink decreases, the arm portion 473 moves upward as the sensor arm 470 rotates, and the detection target portion 473*a* moves upward in the remaining ink detecting portion 140, the transmissive optical sensor 1014 detects the displacement of the detection target portion 473*a*. Therefore, it is possible to detect by means of the transmissive optical sensor 1014 when the amount of remaining ink is decreased.

Figure 6C:
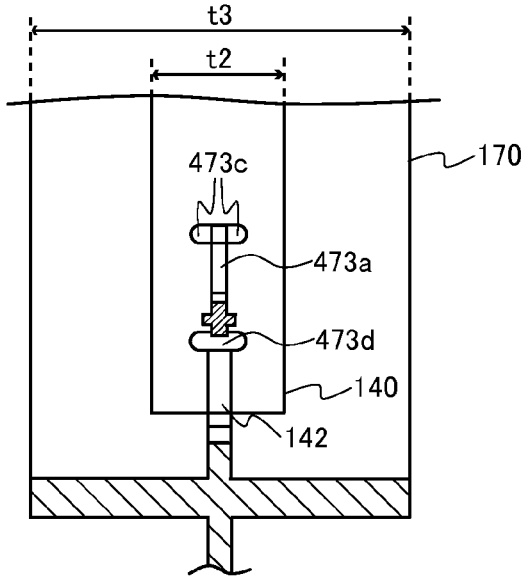
FIG. 6C is a cross sectional view of the vicinity of the remaining ink detecting portion taken along the line in FIG. 6A.

As shown in FIG. 6C, the length t2 along the width direction of the remaining ink detecting portion 140 is shorter than the length t3 along the width direction of the main body portion 170. Therefore, the gap between the light emitting portion 1014*a* and the light receiving portion 1014*b* (see FIG. 7) of the transmissive optical sensor 1014 is made relatively narrow, thus making it possible to reliably detect the detection target portion 473*a* even with an inexpensive sensor.

Next, referring to FIGS. 2A to 2C, the case 200 will be described. As shown in FIGS. 2C and 2A, the case 200 comprises a first case member 210 and a second case member 220, which sandwich the ink reservoir 100 in the width direction. The first case member 210 covers the bottom surface of the ink reservoir 100 and the second case member 220 covers the top surface of the ink reservoir 100.

The first case member 210 and the second case member 220 are formed into substantially the same shape. The first case member 210 has case cutout portions 211, 212, and 213. The second case member 220 has cutout portions 221, 222, and 223. In the condition where the first case member 210 and the second case member 220 sandwich the ink reservoir 100, the case cutout portions 211 and 221 form a substantially circular through hole from which a part of the ink supply portion 120 is exposed to the outside, the case cutout portions 212 and 222 form a substantially circular through hole from which a part of the air intake portion 130 is exposed to the outside, and the case cutout portions 213 and 223 form through holes, at the both sides (the sides in the up-and-down direction in FIGS. 2A and 2C) of the remaining ink detecting portion 140, together with side walls of the remaining ink detecting portion 140 that allow insertion of the transmissive optical sensor 1014 (see FIG. 7) to a position where it sandwiches the remaining ink detecting portion 140.

Next, the outer shape of the case 200 will be described. At the both ends in the short-side direction of the first case member 210 and the second case member 220, formed are stepped portions recessed relative to the surfaces of the first case member 210 and the second case member 220 and extended in the longitudinal direction. At the stepped portions, the first case member 210 and the second case member 220 are welded and the ink reservoir 100 is secured to the case 200. The stepped portions on the ink supply portion 120 side (the right front side in FIGS. 2A and 2C) are first case welded portions 216 and 226, and the stepped portions on the air intake portion 130 (the left back side in FIGS. 2A and 2C) are second case welded portions 217 and 227. An engagement portion 226*a* extending in the short-side direction is formed on the end of the first case welded portion 226 of the second case member 220 on the side opposite the side where the case cutout portion 221 is formed. The same sort of engagement portion as the engagement portion 226*a* is formed also on the first case member 210, although it is not shown. The second case welded portions 217 and 227 have latch portions 217*a* and 227*a* respectively. Each of the latch portions 217*a* and 227*a* is formed into a recessed shape at the approximately central position in the longitudinal direction of the case 200.

The ink cartridge 1 may be produced, for example, as follows.

First, the water-repellent material and the hydrophobic resin are mixed, for example, by a polymer blend or a polymer alloy to obtain a hydrophobic resin containing the water-repellent material in the aforementioned proportion. Then, the remaining ink detecting portion 140 is formed by subjecting the hydrophobic resin containing the water-repellent material to injection molding.

Next, the part of the ink reservoir 100 excluding the remaining ink detecting portion 140 and the film 160 (hereinafter, referred to as the "ink reservoir part") is formed by subjecting the resin material to injection molding. Then, a bonded product is obtained by bonding the remaining ink detecting portion 140 with the ink reservoir part.

Next, the sensor arm 470 is formed by subjecting the resin material to injection molding. Subsequently, the sensor arm 470 is installed in the bonded product, and the film 160 is welded by ultrasonic welding. Thereby the ink reservoir 100 in which the sensor arm 470 is installed is formed.

The first case member 210 and the second case member 220 are each formed by subjecting the resin material to injection molding. Subsequently, the ink reservoir 100 in which the sensor arm 470 is installed is sandwiched between the first case member 210 and the second case member 220, and then the first case member 210 and the second case member 220 are welded. Thereby the ink cartridge 1 is obtained.

In the present embodiment, the remaining ink detecting portion 140 and the ink reservoir part are formed separately and then bonded. In the production of the ink cartridge, the remaining ink detecting portion 140 and the ink reservoir part may be integrally molded by injection molding. In this case, the ink reservoir part is formed using the hydrophobic resin containing the same water-repellent material in the aforementioned proportion as that of the remaining ink detecting portion 140. In the integral molding, one of the remaining ink detecting portion 140 and the ink reservoir part may be formed beforehand and then the other may subsequently be formed in the same molding die by performing injection twice, namely, by separately injecting the hydrophobic resin containing the water-repellent material in the aforementioned proportion to the molding die at the part where the remaining ink detecting portion 140 is formed and injecting the resin material to the molding die at the part where the ink reservoir part is formed.

The ink cartridge contains a water-based ink for ink-jet recording comprising a pigment, water, and a nonionic surfactant (hereinafter this may also be referred to simply as the "water-based ink" or "ink"). Even when the ink cartridge contains a water-based ink comprising a pigment that does not have a light transmissivity, the ink cartridge sufficiently prevents the error in the detection of remaining ink that is caused by the water-based ink that remains in the remaining ink detecting portion 140.

Examples of the pigment include carbon blacks, inorganic pigments, organic pigments, and the like. Examples of the carbon blacks include furnace black, lamp black, acetylene black, channel black, and the like. Examples of the inorganic pigments include titanium oxide pigments, iron oxide pigments, carbon black pigments, and the like. Examples of the organic pigments include azo pigments such as azo lake pigments, insoluble azo pigments, condensed azo pigments, chelate azo pigments, and the like; polycyclic pigments such as phthalocyanine pigments, perylene and perynone pigments, anthraquinone pigments, quinacridone pigments, dioxazine pigments, thioindigo pigments, isoindolinone pigments, quinophthalone pigments, and the like; dye lake pigments such as basic dye lake pigments, acid dye lake pigments, and the like; nitro pigments; nitroso pigments; aniline black daylight fluorescent pigments; and the like. Further, other pigments may be used as long as they are dispersible to an aqueous phase. Examples of the pigments include C. I. Pigment Black 1, 6, and 7; C. I. Pigment Yellow 1, 2, 3, 12, 13, 14, 15, 16, 17, 55, 78, 150, 151, 154, 180, 185, and 194; C. I. Pigment Orange 31 and 43; C. I. Pigment Red 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 196; C. I. Pigment Blue 1, 2, 3, 15, 15:1, 15:2, 15:3, 15:4, 16, 22, and 60; C. I. Pigment Green 7 and 36; and the like.

The pigment may be a self-dispersible pigment. The self-dispersible pigment is a pigment in which at least one of hydrophilic functional groups such as a carbonyl group, a hydroxyl group, a carboxylic acid group, a sulfonic acid group, and a phosphoric acid group and their salts is introduced into a pigment particle directly or through other groups by a chemical bond, and therefore is dispersible to water without using a dispersant. As for the self-dispersible pigment, for example, self-dispersible pigments treated according to the methods described in JP8 (1996)-3498A, JP2000-513396A, JP2009-515007A, and the like may be used. For example, commercially available self-dispersible pigments may be used. Examples thereof include "CAB-O-JET® 200", "CAB-O-JET® 250C", "CAB-O-JET® 260M", "CAB-O-JET® 270Y", "CAB-O-JET® 300", "CAB-O-JET® 400", "CAB-O-JET® 450C", "CAB-O-JET® 465M", and "CAB-O-JET® 470Y" manufactured by Cabot Specialty Chemicals, Inc.; "BONJET® BLACK CW-2" and "BONJET® BLACK CW-3" manufactured by Orient Chemical Industries, Ltd.; "LIOJET® WD BLACK 002C" manufactured by TOYO INK MFG. CO., LTD.; and the like.

As a pigment used as a material of the self-dispersible pigment, either an inorganic pigment or an organic pigment may be used. Further, examples of the pigment suitable to perform the aforementioned treatment include carbon blacks such as "MA8" and "MA100" manufactured by Mitsubishi Chemical Corporation; "COLOR BLACK FW 200" manufactured by Evonik Degussa; and the like.

The amount of the pigment (solid content) to be added relative to the total amount of the water-based ink is not particularly limited and decided suitably according to, for example, a desired optical density, a desired color, or the like. The solid content of pigment is, for example, in the range from 0.1 wt % to 20 wt % and in the range from 0.5 wt % to 10 wt %.

The water-based ink may further comprise, for example, a dye(s) as a coloring agent in addition to the pigment.

The water may be ion-exchange water or pure water. The amount of the water to be added relative to the total amount of the water-based ink (the proportion of the water in the water-based ink) is, for example, in the range from 10 wt % to 90 wt % and in the range from 40 wt % to 80 wt %. The proportion of the water in the water-based ink may be, for example, the balance of the water-based ink, excluding other components.

The nonionic surfactant has a capacity for increasing the penetration of the water-based ink relative to a recording medium, for example. Examples of the nonionic surfactant include polyoxyalkylene alkyl ether surfactants, acetylene glycol surfactants, silicone surfactants, and the like. Examples of the polyoxyalkylene alkyl ether surfactants include polyoxyethylene alkyl ether, polyoxypropylene alkyl ether, and the like. Examples of the acetylene glycol surfactants include ethylene oxide adducts of acetylenediol, and the like. Examples of the silicone surfactants include polyether silicone surfactants, and the like. For example, commercially available nonionic surfactants may be used. Examples thereof include "EMULGEN® 109P" (polyoxyethylene alkyl ether) and "EMULGEN® MS-110" (polyoxypropylene alkyl ether) manufactured by Kao Corporation; "OLFIN® E1010" (ethylene oxide (10 mol) adduct of acetylenediol) manufactured by Nissin Chemical Industry Co., Ltd.; "KF6011" (polyether-modified silicone) manufactured by Shin-Etsu Chemical Co., Ltd.; and the like. One of the nonionic surfactants may be used alone or two or more of them may be used in combination.

The amount of the nonionic surfactant to be added relative to the total amount of the water-based ink (the proportion of the nonionic surfactant in the water-based ink) may be in the range from 0.17 wt % to 1.0 wt % and in the range from 0.2 wt % to 0.8 wt %.

The water-based ink may further comprise an anionic surfactant and a cationic surfactant in addition to the nonionic surfactant.

The water-based ink may further comprise a water-soluble organic solvent. Examples of the water-soluble organic solvent include a humectant and a penetrant. The humectant prevents a water-based ink from drying at a nozzle tip portion of an ink-jet head, for example. The penetrant adjusts a drying rate of a water-based ink on a recording medium, for example.

Examples of the humectant include, but not limited to, lower alcohols such as methyl alcohol, ethyl alcohol, n-propyl alcohol, isopropyl alcohol, n-butyl alcohol, sec-butyl alcohol, tert-butyl alcohol, and the like; amides such as dimethylformamide, dimethylacetamide, and the like; ketones such as acetone and the like; ketoalcohols such as diacetone alcohol and the like; ethers such as tetrahydrofuran, dioxane, and the like; polyalcohols such as polyalkylene glycols, alkylene glycols, glycerin, and the like; 2-pyrrolidone; N-methyl-2-pyrrolidone; 1,3-dimethyl-2-imidazolidinone; and the like. Examples of the polyalkylene glycols include polyethylene glycol, polypropylene glycol, and the like. Examples of the alkylene glycols include ethylene glycol, propylene glycol, butylene glycol, diethylene glycol, triethylene glycol, dipropylene glycol, tripropylene glycol, thiodiglycol, hexylene glycol, and the like. One of the humectants may be used alone or two or more of them may be used in combination. Among them, for example, the humectant may be polyalcohols such as alkylene glycols, glycerin, and the like.

The amount of the humectant to be added relative to the total amount of the water-based ink is, for example, in the range from 0 wt % to 95 wt %, in the range from 5 wt % to 80 wt %, and in the range from 5 wt % to 50 wt %.

Examples of the penetrant include glycol ethers. Examples of the glycol ethers include ethylene glycol methyl ether, ethylene glycol ethyl ether, ethylene glycol-n-propyl ether, diethylene glycol methyl ether, diethylene glycol ethyl ether, diethylene glycol-n-propyl ether, diethylene glycol-n-butyl ether, diethylene glycol-n-hexyl ether, triethylene glycol methyl ether, triethylene glycol ethyl ether, triethylene glycol-n-propyl ether, triethylene glycol-n-butyl ether, propylene glycol methyl ether, propylene glycol ethyl ether, propylene glycol-n-propyl ether, propylene glycol-n-butyl ether, dipropylene glycol methyl ether, dipropylene glycol ethyl ether, dipropylene glycol-n-propyl ether, dipropylene glycol-n-butyl ether, tripropylene glycol methyl ether, tripropylene glycol ethyl ether, tripropylene glycol-n-propyl ether, tripropylene glycol-n-butyl ether, and the like. One of the penetrants may be used alone or two or more of them may be used in combination.

The amount of the penetrant to be added relative to the total amount of the water-based ink is, for example, in the range from 0 wt % to 20 wt %, in the range from 0.1 wt % to 15 wt %, and in the range from 0.5 wt % to 10 wt %.

The water-based ink may further comprise a conventionally known additive(s), if necessary. Examples of the additive include a pH adjuster, a viscosity modifier, a surface tension modifier, a mildewproofing agent, and the like. Examples of the viscosity modifier include polyvinyl alcohols, celluloses, water-soluble resins, and the like.

The water-based ink may be prepared, for example, by uniformly mixing the pigment, water, the nonionic surfactant, and optionally other added components by a conventionally known method, and then removing sediments with a filter or the like.

The ink cartridge may be used, for example, for the ink-jet recording apparatus.

The light emitted from the light emitting portion 1014*a* may be infrared light in view of the transmissivity relative to the ink stored in the ink cartridge and the prevention of deterioration of the ink, although visible light is applicable.

Next, referring to FIG. 7, the method of installing the ink cartridge 1 to the ink-jet recording apparatus will be described. In FIG. 7, the ink-jet recording apparatus 1000 is the aforementioned ink-jet recording apparatus.

As shown in FIG. 7, an installation portion 1010 of the ink-jet recording apparatus 1000 comprises a latch rod 1011 and a support portion 1012. The latch rod 1011 protrudes from the installation surface 1013, which faces to the ink supply portion 120 and the air intake portion 130 of the ink cartridge 1 when the ink cartridge 1 is installed, in the direction orthogonal to the installation surface 1013 (to the right in FIG. 7) and latches with the latch portions 217*a* and 227*a* of the case 200. The support portion 1012 supports the first case welded portions 216 and 226 of the case 200 from below and is formed into a recessed shape matching the shape of the first case welded portions 216 and 226. On the latch rod 1011, a convex portion 1011*a* is formed which is protruded toward the support portion 1012 and is formed into substantially the same shape as the latch portions 217*a* and 227*a*.

The transmissive optical sensor 1014 is arranged on the installation surface 1013 of the installation portion 1010. The transmissive optical sensor 1014 is formed into a substantially inverted C shape, with the open end of the inverted C shape being the light emitting portion 1014*a*, which emits light, and the other end being the light receiving portion 1014*b*, which receives light. The light emitting portion 1014*a* and the light receiving portion 1014*b* are attached projecting from the installation surface 1013 so as to be inserted into the through holes formed by the case cutout portions 213 and 223 and the remaining ink detecting portion 140 respectively. The transmissive optical sensor 1014 is configured not to send (or to send) a signal to a control board (not shown) provided on the ink-jet recording apparatus 1000 when the light emitted from the light emitting portion 1014*a* is received by the light receiving portion 1014*b*, and to send (or not to send) a signal to the control board when the light emitted from the light emitting portion 1014*a* is blocked and is not received by the light receiving portion 1014*b*.

Further, on the side of the installation surface 1013 corresponding to the ink supply portion 120 (the lower side in FIG. 7A), a projecting ink extraction tube 1015 is provided, while on the side of the installation surface 1013 corresponding to the air intake portion 130 (the upper side in FIG. 7A), the installation surface 1013 is formed as a flat surface. An ink flow passage 1013*a* is connected to the ink extraction tube 1015, and ink is supplied to an ejection opening (not shown) through the ink flow passage 1013*a*. Further, an air intake passage 1013*b* is formed on the installation surface 1013 at the air intake portion 130 side, and air is taken into the ink cartridge 1 (the ink tank 110) through the air intake passage 1013*b*.

Moreover, the installation portion 1010 is provided with an engagement member 1017, which engages and rotates with the engagement potions 216*a* and 226*a* of the case 200, on the tip (the right side in FIG. 7A, the ink cartridge 1 side end) of the support portion 1012. The engagement member 1017 comprises an engagement end portion 1017*a* and a cover portion 1017*c*. The engagement end portion 1017*a* engages with the engagement portions 216*a* and 226*a* of the case 200, and the cover portion 1017*c* connects with the engagement end portion 1017*a* and covers the surface of the case 200 opposite the surface facing to the installation portion 1010.

Installation of the ink cartridge 1 is carried out by inserting such that the first case welded portions 216 and 226 of the case 200 contact with the support portion 1012 and pushing so that the first case welded portions 216 and 226 slide over the support portion 1012. In other words, as shown in FIG. 7A, the ink cartridge 1 is slid in the direction of the arrow E.

As shown in FIG. 7B, when the ink cartridge 1 is pushed toward the installation portion 1010 (to the left in FIG. 7B), the latch rod 1011 is depressed by the second case welded portions 217 and 227 and elastically deformed away from the support portion 1012. Further, engagement end portion 1017*a* of the engagement member 1017 comes into contact with the engagement portions 216*a* and 226*a*. Then, as the ink cartridge 1 is pushed in, the engagement member 1017 rotates upward (in the direction of the arrow F in FIG. 7B).

As shown in FIG. 7C, when the ink cartridge 1 is further pushed in from the state of FIG. 7B (or when the user rotates the engagement member 1017 in the direction of the arrow F in FIG. 7B), the convex portion 1011*a* of the latch rod 1011 latches with the latch portions 217*a* and 227*a* of the case 200, thereby securing the ink cartridge 1. Thus, when the ink cartridge 1 has been installed in the installation portion 1010, it is prevented from easily being detached due to printing vibrations or the like.

Further, when the ink cartridge 1 is installed in the installation portion 1010, the ink extraction tube 1015 is inserted into the ink supply portion 120, enabling ink supply, and the transmissive optical sensor 1014 is inserted into the through holes formed by the case cutout portions 213 and 223 and the remaining ink detecting portion 140, enabling the detection of remaining ink.

With the ink cartridge 1 of the present embodiment, when the ink cartridge 1 is installed in the ink-jet recording apparatus 1000, the remaining ink detecting portion 140 is placed between the light emitting portion 1014*a* and the light receiving portion 1014*b* of the transmissive optical sensor 1014 provided in the ink-jet recording apparatus 1000. Therefore, the detection target portion 473*a* is reliably detected with a simple mechanism.

Figure 8A:
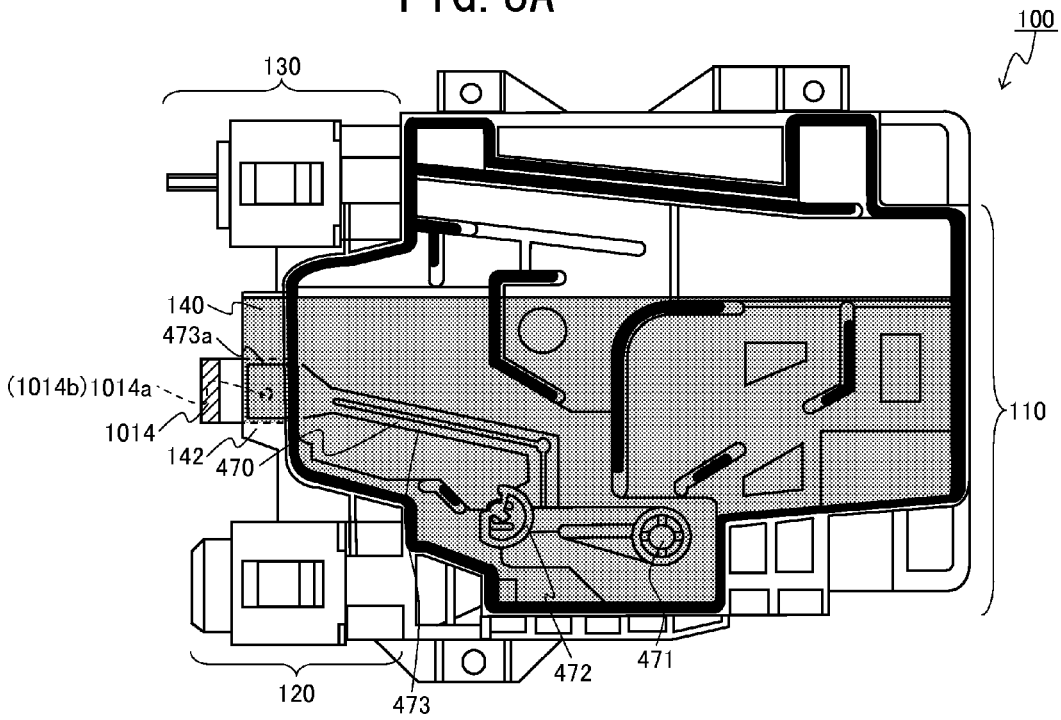
FIG. 8A is an explanatory view showing the state where there is ink remaining for explaining the method of detecting the amount of ink that remains in the ink tank of the ink reservoir shown in FIG. 4.
Figure 8B:
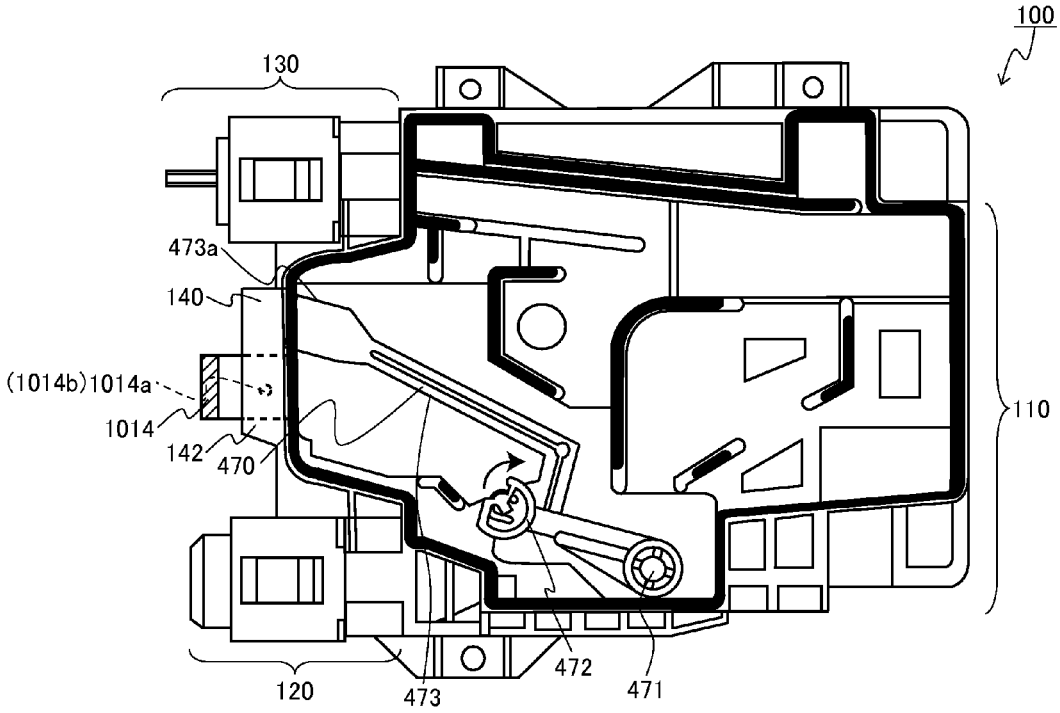
FIG. 8B is an explanatory view showing the state with no ink remaining for explaining the method of detecting the amount of ink that remains in the ink tank of the ink reservoir shown in FIG. 4.

Next, referring to FIGS. 8A and 8B, the method of detecting the amount of ink that remains in the ink tank 110 will be described. FIG. 8A shows the state where there is ink remaining, while FIG. 8B shows the state with no ink remaining.

As shown in FIG. 8A, in the state where a large amount of ink is stored in the ink tank 110 (the state where at least the ink level is positioned above the position of the float portion 471 when the detection target portion 473*a* is in contact with the stopper 142), as described above, the counterclockwise moment acting on the sensor arm 470 is greater than the clockwise moment, so the float portion 471 floats in the ink. At this time, the detection target portion 473*a* of the sensor arm 470 is positioned at a detection position where it obstructs the gap between the light emitting portion 1014*a* and the light receiving portion 1014*b* of the transmissive optical sensor 1014. This state is the ink-present state, and the determination of the ink-present state is made on the control board (not shown) of the ink-jet recording apparatus 1000. As described above, the light emitted from the light emitting portion 1014*a* may be infrared light, although visible light is applicable.

Subsequently, when the ink in the ink tank 110 is decreased and the arm portion 473 is exposed from the ink, the buoyancy acting on the arm portion 473 decreases. As a result, the counterclockwise moment acting on the sensor arm 470 becomes smaller, but there is no change of the fact that the counterclockwise moment is greater than the clockwise moment, so the sensor arm 470 stays at the position shown in FIG. 8A. As ink decreases further and the float portion 471 is exposed from the ink, the buoyancy acting on the arm portion 473 decreases. As a result, the counterclockwise moment acting on the sensor arm 470 becomes smaller. When a part of the float portion 471 is exposed from the ink, the counterclockwise moment and the clockwise moment become equal. Thereafter, when the ink decreases further, the float portion 471 moves downward following the ink level dropping. When the ink in the ink tank 110 is nearly gone, the float portion 471 of the sensor arm 470 touches the bottom surface of the ink tank 110. The downward movement of the float portion 471 causes the sensor arm 470 to be rotated in the clockwise direction (the direction of the arrow in FIG. 8B) about the attachment portion 472 and causes the detection target portion 473*a* of the sensor arm 470 to be displaced upward. When the detection target portion 473*a* is displaced up to a non-detection position where it does not obstruct the gap between the light emitting portion 1014*a* and the light receiving portion 1014*b* of the transmissive optical sensor 1014, light passes between the light emitting portion 1014*a* and the light receiving portion 1014*b*. This state is the out-of-ink state, and the determination of the out-of-ink state is made on the control board (not shown) of the ink-jet recording apparatus 1000.

In the ink cartridge 1 of the present embodiment, the amount of remaining ink is detected with the sensor arm 470. However, the ink cartridge may be the one in which ink itself obstructs detection light and that detects the amount of remaining ink by the light transmitted as ink decreases.

EXAMPLES

Next, Examples are described together with Comparative Examples. However, the present invention is not limited to the following Examples.

(Formation of Test Piece)

The water-repellent materials and the hydrophobic resins (table 1) were mixed by a polymer blend, the resultant polymer-blended products were subjected to injection molding and the parts of the ink reservoir 100 shown in FIG. 2B excluding the film 160 were formed. Then, test pieces 1 to 11 were cut from the remaining ink detecting portions 140.

(Preparation of Water-Based Ink)

An ink solvent was obtained by uniformly mixing the water-based ink composition components (Table 2) excluding self-dispersible pigment dispersion. Next, the ink solvent was added to each of the self-dispersible pigment dispersion, and mixed uniformly. Thereafter, the resultant mixtures were filtered through a cellulose acetate type membrane filter (pore diameter: 3.00 nm) manufactured by Toyo Roshi Kaisha, Ltd. Thereby water-based inks 1 to 7 for ink-jet recording were obtained.

TABLE 1

(unit: wt %)

| | | Test piece | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Hydrophobic resin | PRIME POLYPRO ® J227T (*1) | 20 | 70 | 85 | 95 | — | 98 | — | — | 99 | 76 | — |
| | PRIME POLYPRO ® J-3000GP (*2) | — | — | — | — | — | — | 98 | 80 | — | — | 100 |
| Water-repellent material | POLYFINE ® MF18R (*3) | 80 (5.60) | 30 (2.10) | 15 (1.05) | 5 (0.35) | 100 (7.00) | 2 (0.14) | — | — | 1 (0.07) | — | — |
| | DOW CORNING TORAY BY27-001 (*4) | — | — | — | — | — | — | 2 (1.00) | 20 (10.0) | — | 24 (12.0) | — |

TABLE 2

(unit: wt %)

| | Water-based ink | | | | | | |
|---|---|---|---|---|---|---|---|
| | 1 | 2 | 3 | 4 | 5 | 6 | 7 |
| CAB-O-JET ® 300 (*5) | 26.7 (4.0) | 33.3 (5.0) | 33.3 (5.0) | — | 26.7 (4.0) | 33.3 (5.0) | 33.3 (5.0) |
| CAB-O-JET ® 250C (*6) | — | — | — | 30.0 (3.0) | — | — | — |
| Glycerin | 20.0 | 15.0 | — | 25.0 | 20.0 | 15.0 | 20.0 |
| Diethylene glycol | 5.0 | — | — | — | 5.0 | — | 5.0 |
| Triethylene glycol | — | — | 15.0 | 3.0 | — | — | — |
| 2-pyrrolidone | — | 5.0 | — | — | — | 5.0 | — |
| Dipropylene glycol-n-propyl ether | 2.0 | — | — | 2.6 | 2.0 | — | 2.0 |
| Triethylene glycol-n-butyl ether | — | 5.0 | 3.0 | — | — | 5.0 | — |
| EMULGEN ® 109P (*7) | — | — | — | 0.2 (0.2) | — | — | — |
| EMULGEN ® MS-110 (*8) | — | 0.3 (0.3) | — | — | — | — | — |
| OLFIN ® E1010 (*9) | 0.8 (0.8) | — | — | — | — | — | — |
| KF6011 (*10) | — | — | 0.15 (0.15) | — | — | — | — |
| NEOPELEX G15 (*11) | — | — | — | — | 3.2 (0.51) | — | — |
| SUNNOL ® NL1430 (*12) | — | — | — | 0.25 (0.07) | — | 3.0 (0.81) | — |
| Water | Balance | Balance | Balance | Balance | Balance | Balance | Balance |

Footnotes of Tables 1 and 2

(*1): PP, manufactured by Prime Polymer Co., Ltd (*2): PP, manufactured by Prime Polymer Co., Ltd.

(*3): manufactured by Prime Polymer Co., Ltd., containing 7 wt % of polyorganosiloxane, numeric values inside parentheses show proportion of water-repellent material (*4): manufactured by Dow Corning Toray Co., Ltd., containing 50 wt % of polyorganosiloxane, numeric values inside parentheses show proportion of water-repellent material (*5): self-dispersible pigment dispersion, manufactured by Cabot Specialty Chemicals, Inc., concentration of pigment = 15 wt %, numeric values inside parentheses show solid content of pigment (*6): self-dispersible pigment dispersion, manufactured by Cabot Specialty Chemicals, Inc., concentration of pigment = 10 wt %, numeric value inside parentheses shows solid content of pigment (*7): nonionic surfactant (polyoxyethylene alkyl ether), manufactured by Kao Corporation, amount of active ingredient = 100 wt %, numeric value inside parentheses shows amount of active ingredient (*8): nonionic surfactant (polyoxypropylene alkyl ether), manufactured by Kao Corporation, amount of active ingredient = 100 wt %, numeric value inside parentheses shows amount of active ingredient (*9): nonionic surfactant (ethylene oxide (10 mol) adduct of acetylenediol), manufactured by Nissin Chemical Industry Co., Ltd., amount of active ingredient = 100 wt %, numeric value inside parentheses shows amount of active ingredient (*10): nonionic surfactant (polyether-modified silicone), manufactured by Shin-Etsu Chemical Co., Ltd., amount of active ingredient = 100 wt %, numeric value inside parentheses shows amount of active ingredient (*11): anionic surfactant (dodecylbenzenesulfonic acid sodium salt), manufactured by Kao Corporation, amount of active ingredient = 16 wt %, numeric value inside parentheses shows amount of active ingredient (*12): anionic surfactant (alkyl ether sodium sulfate), manufactured by Lion Corporation, amount of active ingredient = 27 wt %, numeric values inside parentheses show amount of active ingredient

Examples 1 to 8 and Comparative Examples 1 to 5

Using the test pieces 1 to 11 in combination with each of the water-based inks 1 to 7, (a) water repellency, (b) quality of recorded image, and (c) elution of water-repellent material were measured and evaluated according to the following methods.

(a) Evaluation of Water Repellency

The test pieces were immersed in the water-based inks for 1 minute and taken out. The time (water-repelling time) between the time when the test piece was taken out from the water-based ink and the time when the adhered water-based ink on the test piece was run down (was gone) was measured, and the evaluation was made according to the following evaluation criteria.

Evaluation Criteria for Water Repellency Evaluation

AA: water-repelling time was shorter than 30 seconds

A: water-repelling time was 30 seconds or longer and shorter than 120 seconds

C: water-repelling time was unmeasurable (adhered water-based ink on test piece has never gone)

(b) Evaluation of Quality of Recorded Image

Using a digital multi-function center DCP-385C which on an ink-jet printer mounted, manufactured by Brother Industries, Ltd., evaluation samples were prepared by recording monochrome patches at 600 dpi×600 dpi resolution and 100% coverage on recording paper ("My Paper" manufactured by Ricoh Co., Ltd.) with the water-based inks of Examples and Comparative Examples.

Evaluation Criteria for Recorded Image Quality Evaluation

AA: White streaks were not observed and quality of recorded image was excellent

A: White streaks were hardly observed and quality of recorded image was good

C: White streaks were clearly observed and quality of recorded image was poor (c) Evaluation of Elution of Water-Repellent Material 10 mL of each of the water-based inks was put in an airtight container. Then, the test pieces were immersed in the water-based inks in the containers and were allowed to stand in a thermostat bath at 60° C. for two weeks. After being allowed to stand, the test pieces were taken out from the water-based inks. The water-based inks that remain in the containers were each filtered through a cellulose acetate type membrane filter (pore diameter: 0.8 μm) manufactured by ADVANTEC, and the time (X) required for filtration was measured. Further, as a control, each of the water-based inks alone was allowed to stand under the same conditions (60° C. for two weeks). After being allowed to stand, the water-based inks that remain in the containers were each filtered through the filter, and the time required for filtration was measured. The time required for filtering the control was defined as the criterion time (Y). The ratio of the time required for filtering the water-based ink, in which the test piece was immersed, relative to the criterion time [Z=X/Y (ratio)] was obtained. The evaluation was made based on the ratio Z according to the following evaluation criteria.

Evaluation Criteria for Water-Repellent Material Elution Evaluation

AA: Ratio Z is less than 1.1

A: Ratio Z is 1.1 or more and less than 1.2

C: Ratio Z is 1.2 or more

The evaluation results of Examples 1 to 8 and Comparative Examples 1 to 5 are summarized in Table 3.

TABLE 3

| | | | Example | | | | | | | |
|---|---|---|---|---|---|---|---|---|---|---|
| | | | 1 | 2 | 3 | 4 | 5 | 6 | 7 | 8 |
| | Test piece | | 1 | 2 | 3 | 4 | 5 | 6 | 7 | 8 |
| Water-based ink 1 | Evaluation | Water repellency | AA | AA | AA | AA | AA | A | AA | AA |
| (nonionic surfactant: 0.8 wt %) | | Quality of recorded image | AA | AA | AA | AA | AA | AA | AA | AA |
| | | Elution of water-repellent material | AA | AA | AA | AA | A | AA | AA | A |
| Water-based ink 2 | | Water repellency | — | AA | AA | — | — | — | AA | AA |
| (nonionic surfactant: 0.3 wt %) | | Quality of recorded image | — | AA | AA | — | — | — | AA | AA |
| | | Elution of water-repellent material | — | AA | AA | — | — | — | AA | A |
| Water-based ink 3 | | Water repellency | AA | — | AA | — | AA | — | — | — |
| (nonionic surfactant: 0.15 wt %) | | Quality of recorded image | A | — | A | — | A | — | — | — |
| | | Elution of water-repellent material | AA | — | AA | — | A | — | — | — |
| Water-based ink 4 | | Water repellency | — | — | AA | AA | — | A | — | — |
| (nonionic surfactant: 0.2 wt % | | Quality of recorded image | — | — | AA | AA | — | AA | — | — |
| anionic surfactant: 0.07 wt %) | | Elution of water-repellent material | — | — | AA | AA | — | AA | — | — |
| Water-based ink 5 | | Water repellency | — | — | — | — | — | — | — | — |
| (anionic surfactant: 0.51 wt %) | | Quality of recorded image | — | — | — | — | — | — | — | — |
| | | Elution of water-repellent material | — | — | — | — | — | — | — | — |
| Water-based ink 6 | | Water repellency | — | — | — | — | — | — | — | — |
| (anionic surfactant: 0.81 wt %) | | Quality of recorded image | — | — | — | — | — | — | — | — |
| | | Elution of water-repellent material | — | — | — | — | — | — | — | — |
| Water-based ink 7 | | Water repellency | — | — | — | — | — | — | — | — |
| (surfactant: none) | | Quality of recorded image | — | — | — | — | — | — | — | — |
| | | Elution of water-repellent material | — | — | — | — | — | — | — | — |

| | | | Comparative Example | | | | |
|---|---|---|---|---|---|---|---|
| | | | 1 | 2 | 3 | 4 | 5 |
| | Test piece | | 9 | 10 | 11 | 3 | 3 |
| Water-based ink 1 | Evaluation | Water repellency | C | AA | C | — | — |
| (nonionic surfactant: 0.8 wt %) | | Quality of recorded image | AA | AA | AA | — | — |
| | | Elution of water-repellent material | AA | C | AA | — | — |
| Water-based ink 2 | | Water repellency | C | — | — | — | — |
| (nonionic surfactant: 0.3 wt %) | | Quality of recorded image | AA | — | — | — | — |
| | | Elution of water-repellent material | AA | — | — | — | — |
| Water-based ink 3 | | Water repellency | — | AA | C | — | — |
| (nonionic surfactant: 0.15 wt %) | | Quality of recorded image | — | A | A | — | — |
| | | Elution of water-repellent material | — | C | AA | — | — |
| Water-based ink 4 | | Water repellency | — | — | — | — | — |
| (nonionic surfactant: 0.2 wt % | | Quality of recorded image | — | — | — | — | — |
| anionic surfactant: 0.07 wt %) | | Elution of water-repellent material | — | — | — | — | — |
| Water-based ink 5 | | Water repellency | — | — | AA | — | — |
| (anionic surfactant: 0.51 wt %) | | Quality of recorded image | — | — | C | — | — |
| | | Elution of water-repellent material | — | — | AA | — | — |
| Water-based ink 6 | | Water repellency | — | — | — | AA | — |
| (anionic surfactant: 0.81 wt %) | | Quality of recorded image | — | — | — | C | — |
| | | Elution of water-repellent material | — | — | — | AA | — |
| Water-based ink 7 | | Water repellency | — | — | — | — | AA |
| (surfactant: none) | | Quality of recorded image | — | — | — | — | C |
| | | Elution of water-repellent material | — | — | — | — | AA |

As summarized in Table 3, Examples 1 to 8 in which the test pieces 1 to 8, in which the proportion of the water-repellent material was in the range from 0.14 wt % to 10 wt %, were used showed favorable results in the water repellency evaluation, the recorded image quality evaluation, and the water-repellent material elution evaluation. Especially, Examples 1 to 4 and 7 in which the test pieces 1 to 4 and 7, in which the proportion of the water-repellent material is in the range from 0.35 wt % to 6.4 wt %, were used showed very favorable results in the water repellency evaluation and the water-repellent material elution evaluation. With respect to Examples 1 to 8, particularly favorable results were obtained in the cases in which the water-based inks 1, 2, and 4, in which the proportion of the nonionic surfactant is in the range from 0.17 wt % to 1.0 wt %, were used. In contrast, Comparative Example 1 in which the test piece 9, in which the proportion of the water-repellent material is 0.07 wt %, was used showed an unfavorable result in the water repellency evaluation. Comparative Example 2 in which the test piece 10, in which the proportion of the water-repellent material is 12.0 wt %, was used showed an unfavorable result in the water-repellent material elution evaluation. Comparative Example 3 in which the test piece 11 that does not contain the water-repellent material was used showed an unfavorable in the water repellency evaluation in the cases where the water-based inks 1 and 3 were used, and showed an unfavorable result in the recorded image quality evaluation in the case where the water-based ink 5 that contains only the anionic surfactant as a surfactant was used. Comparative Example 4 in which the test piece 3 and the water-based ink 6 that contains only anionic surfactant as a surfactant were used showed an unfavorable result in the recorded image quality evaluation. Comparative Example 5 in which the test piece 3 and the water-based ink 7 that does not contain a surfactant were used showed an unfavorable result in the recorded image quality evaluation.

It will be obvious to those having skill in the art that many changes may be made in the above-described details of the particular aspects described herein without departing from the spirit or scope of the invention as defined in the appended claims.

What is claimed is:

1. An ink cartridge for containing a water-based ink for ink jet recording comprising a pigment, water, and a nonionic surfactant, comprising:

a remaining ink detecting portion detecting an amount of remaining ink on the basis of whether or not light is transmitted therethrough, wherein the remaining ink detecting portion is formed of a polymer blend or polymer alloy comprising (i) a hydrophobic resin and (ii) a water-repellent material in an amount of 0.14 wt % to 10 wt %.

2. An ink cartridge for containing a water-based ink for ink jet recording comprising a pigment, water, and a nonionic surfactant, comprising:

a remaining ink detecting portion detecting an amount of remaining ink on the basis of whether or not light is transmitted therethrough, wherein the remaining ink detecting portion is formed of a polymer blend or polymer alloy comprising (i) a hydrophobic resin and (ii) a water-repellent material in an amount of 0.14 wt % to 10 wt %, wherein the water-repellent material is a material having lower surface free energy than the hydrophobic resin.

3. The ink cartridge according to claim 1, wherein the water-repellent material is at least one of a silicon-containing compound and a fluorine-containing compound.

4. The ink cartridge according to claim 3, wherein the silicon-containing compound is polyorganosiloxane.

5. The ink cartridge according to claim 1, wherein the hydrophobic resin is polyolefin.

6. The ink cartridge according to claim 5, wherein the polyolefin is at least one of polypropylene and polyethylene.

7. The ink cartridge according to claim 1, wherein an amount of the water-repellent material to be added relative to the total amount of the hydrophobic resin is in the range from 0.35 wt % to 6.4 wt %.

8. The ink cartridge according to claim 1, wherein the pigment is a self-dispersible pigment.

9. The ink cartridge according to claim 1, wherein the nonionic surfactant is at least one selected from the group consisting of polyoxyalkylene alkyl ether surfactants, acetylene glycol surfactants, and silicone surfactants.

10. The ink cartridge according to claim 1, wherein an amount of the nonionic surfactant to be added relative to the total amount of the water-based ink is in the range from 0.17 wt % to 1.0 wt %.

11. An ink jet recording apparatus comprising:

an ink cartridge;

an ink ejecting unit; and a remaining ink detecting unit, wherein the ink ejecting unit ejects an ink contained in the ink cartridge, the ink cartridge is the ink cartridge according to claim 1, the remaining ink detecting unit comprises a transmissive optical sensor provided with a light emitting portion and a light receiving portion, and the remaining ink detecting portion of the ink cartridge is placed between the light emitting portion and the light receiving portion.

* * * * *